United States Patent [19]

Hirt et al.

[11] 4,381,708

[45] May 3, 1983

[54] DUCTOR BLADE ADJUSTING DEVICE FOR PRINTING MACHINES, IN PARTICULAR FOR WEB-FED PRINTING MACHINES

[76] Inventors: Dieter Hirt, Auerbergweg 10; Zdravko Krovinovic, Brücken Str. 16 A, both of 8900 Augsburg; Rupert Schmitt, 8901, Holzhausen Nr. 51 1/4, all of Fed. Rep. of Germany

[21] Appl. No.: 183,761

[22] Filed: Sep. 3, 1980

[30] Foreign Application Priority Data

Sep. 3, 1979 [DE] Fed. Rep. of Germany ..... 2935489

[51] Int. Cl.[3] ..... B41F 31/02

[52] U.S. Cl. ..... 101/365

[58] Field of Search ..... 101/365, 364

[56] References Cited

U.S. PATENT DOCUMENTS 4,193,345 3/1980 Schoneberger et al. ..... 101/365

FOREIGN PATENT DOCUMENTS 2000082 1/1979 United Kingdom ..... 101/365

2024457 1/1980 United Kingdom ..... 101/365

*Primary Examiner*—Richard J. Apley

*Assistant Examiner*—David J. Isabella

*Attorney, Agent, or Firm*—Posnack, Roberts, Cohen & Spiecens

[57] ABSTRACT

A device for adjusting a doctor blade of a printing machine comprising an inking roller facing the doctor blade and adapted to be spaced therefrom by a gap to establish a predetermined ink thickness on the inking roller. Sensors are coupled to the doctor blade for determining the spacing between the inking roller and the doctor blade. Servomotors are coupled to the doctor blade to adjust the position of the doctor blade thereby to adjust the size of the gap. A microcomputer receives signals from the sensors to compare signals from the sensors with the desired gap according to given values of ink thickness and for sending signals to the servomotors to adjust the doctor blade so that the actual distance and the desired distance correspond. The microcomputer also receives the signals from the sensors in non-adjusted state when the inking roller is in contact with the doctor blade to establish this as the zero position of the doctor blade. The zero position can be detected automatically before each resetting of the doctor blade or it can be detected at periodic intervals or by external instruction.

2 Claims, 3 Drawing Figures

DUCTOR BLADE ADJUSTING DEVICE FOR PRINTING MACHINES, IN PARTICULAR FOR WEB-FED PRINTING MACHINES

FIELD OF THE INVENTION

The invention relates to a doctor blade setting device for printing machines, in particular for web-fed printing machines, with sensors to determine by electric means the actual distance between an inking roller and a related doctor blade which is adjustable by servomotors. A microcomputer is provided which calculates the desired distance between the inking roller and the doctor blade according to given values, compares this desired distance with the actual distance and, where a difference is found, communicates this to the servomotors which then adjust the doctor blade so that the actual value and desired value correspond.

BACKGROUND

In the case of web-fed printing machines, the ink feed is spread over the width of the printing form in varying amounts in columns. The thickness of the ink layer in the individual columns is determined by the gap between an inking roller and its corresponding doctor blade, which is in the form either of a flexible individual element or alternatively of several individual slides arranged side by side and moving independently of one another. The flexible doctor blade is, or the slides are, adjustable to the desired position in relation to the inking roller by electric servomotors.

The position of the blade or slides relative to the inking roller is electrically measured by sensors and indicated on a remote-control operator's console.

In the case of large newpaper printing machines with many printing units, up to 1000 individual gap sensors have to be precisely adjusted before putting the machine into operation. As practice has shown, this is very time consuming since the sensors have to be mechanically set precisely to one-hundredth of a millimetre and their related signal amplifiers so coordinated that all column gaps can be measured with the same zero point, same scale and same exactness.

Since not only the flexible doctor blades but also the alternative slides as well as the inking rollers wear in the course of time, readjustment is frequently necessary, especially when the wear necessitates complete replacement. As a rule this entails considerable work with correspondingly high costs.

SUMMARY OF THE INVENTION

An object of the invention is to provide a doctor blade setting device adapted to eliminate the necessity of adjusting the sensitivety of the sensors before putting the printing machine into operation and also to eliminate readjustment of the sensitivities sensors.

The invention satisfies this object in that the microcomputer records the gap signalled by the unadjusted sensors even when the inking roller and doctor blade are touching one another, stores this information and evaluates it as the doctor blade's zero setting.

DETAILED DESCRIPTION

Figure 1:
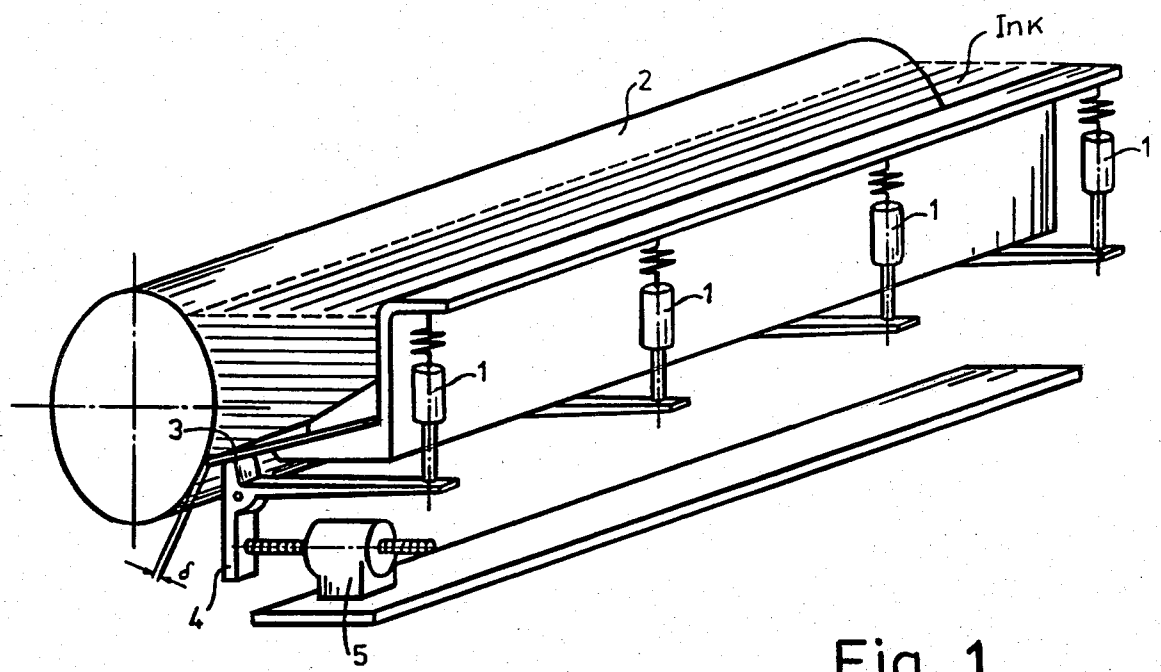
FIG. 1 shows an inking roller and its related doctor blade with adjusting device in a highly schematic perspective illustration.

The mechanical part of the doctor blade adjusting device according to the invention is shown in FIG. 1. It has a number of sensors 1, which measure the gap $\delta$ between an inking roller 2 (doctor) and the tip of a flexible doctor blade 3 at several points from the position of adjusting levers 4. The adjusting levers 4 are acted on by spindle-type servomotors 5, to bring the doctor blade 3 to the desired distance $\delta$ from the inking roller 2.

Figure 2:
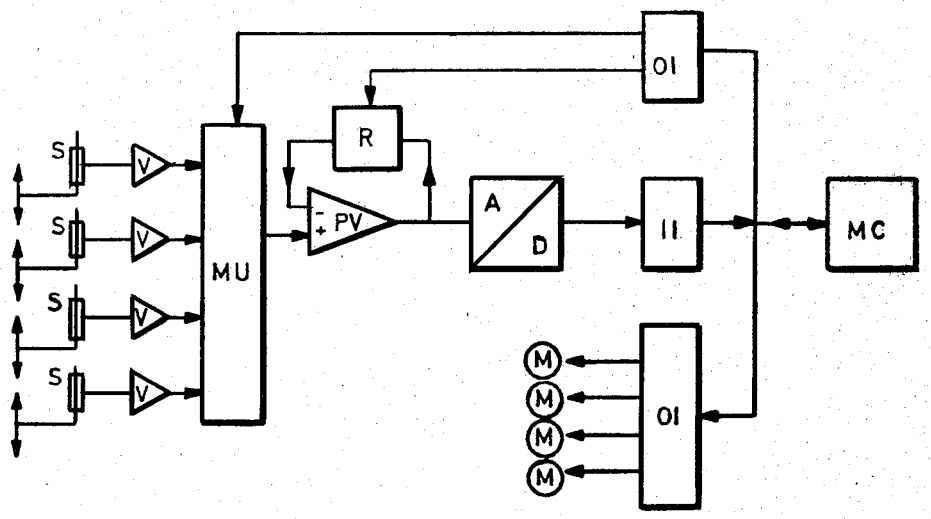
FIG. 2. shows the circuit layout of a doctor blade adjusting device according to the invention.

The electrical part of the doctor blade adjusting device is shown in the circuit diagram in FIG. 2. The sensors S are each connected, via a preamplifier V, to a multiplexer MU which in turn is connected, via a programmable amplifier PV, an analog/digital converter A/D and an input interface II, to a microcomputer MC. From the microcomputer MC one channel leads via an output interface OI to the servomotors M, and a second channel via a further output interface OI to the multiplexer MU. This second output interface is connected to the programmable amplifier PV via a controllable feedback circuit R.

The microcomputer MU is so programmed that at the beginning of the adjusting process the servomotors initially set the doctor blade 3 are into contact with the inking roller 2 (ductor) over the entire width, and the sensor signals, which are measured with uniform amplification and digitalized, are detected and stored.

Thereafter all the servomotors are adjusted for increasing ink feed and any differences in sensitivity of the individual gap sensors are detected and their detected gap valves are correspondingly amplified by amplifiers PV by means of automatic amplification correction. The subsequent known adjusting process then takes place based on the individual zero point values stored in the computer with the respective corrected sensor signals based on the determined sensitivities of the individual gap sensors.

Figure 3:
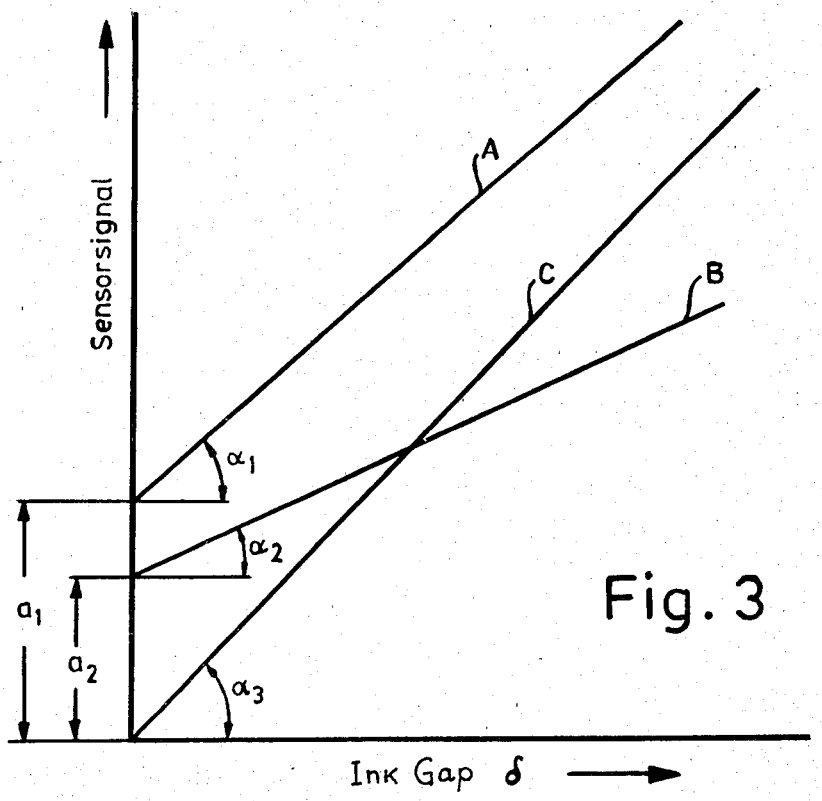
FIG. 3 is a graphical depiction of sensor characteristic curves as a function of ink gap size.

FIG. 3 shows two different sensor characteristic curves, A and B, with inclinations $\alpha_1$, and $\alpha_2$, which are displaced from zero by $a_1$ and $a_2$. These characteristic curves A and B can be corrected by software in the device according to this invention, so that by different amplification of the sensor signals by amplifiers PV one obtains a uniform characteristic curve C with inclination $\alpha_3$.

What is claimed is:

1. A doctor blade adjusting device for a printing machine comprising an inking roller, a doctor blade facing said inking roller and adapted to be spaced therefrom by a gap to establish a predetermined ink thickness on the inking roller, a plurality of sensor means operatively associated with said inking roller and doctor blade for determining the spacing between the inking roller and the doctor blade, servomotor means operatively coupled to said doctor blade for adjusting the size of said gap, and microcomputer means connected to said plurality of sensor means and said servomotor means for receiving input signals from said sensor means (1) for calculating the desired distance between the inking roller and the doctor blade according to given values of ink thickness (2) for comparing this desired distance with the actual distance and (3) for sending signals to said servomotor means to adjust the doctor blade so that the actual distance and the desired distance correspond, said microcomputer means also receiving (a) the distances determined by the individual sensor means in an initial non-adjusted state when the inking roller is touching the doctor blade and establishing this as the zero position of the doctor blade and (b) the distances determined by the individual sensor means in an adjusted position of the blade, said microcomputer means evaluating respective sensitivities of the individual sensor means on the basis of the distances from (a) and (b) and supplying said sensitivities for utilization in the setting of the doctor blade to the desired adjusted position.

2. A method of adjusting a doctor blade with respect to an inking roller of a printing machine for establishing a predetermined ink thickness on the inking roller, said method comprising sensing the spacing between the doctor blade and the inking roller at a plurality of locations along the blade and roller by individual sensors and producing signals related thereto, receiving said signals and calculating the desired spacing between the doctor blade and the inking roller for different values of ink thickness, comparing the actual spacing with the desired spacing, and adjusting the doctor blade so that the actual spacing conforms to the desired spacing, said sensing of the spacing at said plurality of locations being effected when the doctor blade is in contact with the inking roller to establish this position as the zero position of the doctor blade and the sensing of the spacing at said plurality of locations being effected at a second setting at a spacing of the doctor blade and inking roller, determining the sensitivity of the individual sensor on the basis of said values of spacing as measured by the sensors at the zero position and said second setting of the doctor blade, and adjusting the doctor blade to the desired settings thereof on the basis of the values sensed at zero position of the inking roller and doctor blade and the determined values of respective sensitivities of the sensors for different values of ink thickness.

* * * * *